US005301548A

United States Patent [19]

Theurer

[11] Patent Number: 5,301,548

[45] Date of Patent: Apr. 12, 1994

[54] TRACK MEASURING CAR

[75] Inventor: Josef Theurer, Vienna, Austria

[73] Assignee: Franz Plasser Bahnbaumaschinen-Industriegesellschaft m.b.H., Vienna, Austria

[21] Appl. No.: 900,910

[22] Filed: Jun. 18, 1992

[30] Foreign Application Priority Data

Jun. 27, 1991 [AT] Austria ..... A1287/91

[51] Int. Cl.[5] ..... E01B 29/04

[52] U.S. Cl. ..... 73/146; 33/287

[58] Field of Search ..... 33/1 Q, 287, 338, 651, 33/651.1; 104/7.2, 7.1; 73/146

[56] References Cited

U.S. PATENT DOCUMENTS 3,455,249 7/1969 Stewart ..... 104/7.1

3,750,299 8/1973 Plasser et al. ..... 33/287

*Primary Examiner*—Richard E. Chilcot, Jr.

*Assistant Examiner*—Joseph L. Felber

*Attorney, Agent, or Firm*—Collard & Roe

[57] ABSTRACT

A measuring car arrangement for monitoring an existing track position with respect to a desired track position comprises a measuring car having a frame extending longitudinally in a plane and undercarriages supporting the frame for mobility in an operating direction and having wheels with contact points with the rail heads. The contact points define a reference plane, the frame plane extending parallel to the reference plane. The arrangement further comprises a satellite bogie transportable on the measuring car frame and being drivable along the track independently of the measuring car. The measuring car and the satellite bogie have an upper periphery not projecting beyond a limiting plane enclosing a dihedral angle of 5° to 10° with the reference plane, and the limiting plane and the frame plane define an intersecting line at a forward end of the measuring car in the operating direction, the intersecting line extending perpendicularly to the longitudinal extension of the frame and parallel to the reference plane.

17 Claims, 1 Drawing Sheet

TRACK MEASURING CAR

BACKGROUND OF THE INVENTION

1. Field of the Invention

The present invention relates to a measuring car arrangement for monitoring an existing track position with respect to a desired track position, the track comprising two rails having rail heads, which comprises a measuring car having a frame extending longitudinally in a plane and undercarriages supporting the frame for mobility in an operating direction and having wheels, the wheels having contact points with the rail heads and the contact points defining a reference plane, the frame plane extending parallel to the reference plane, and a satellite bogie transportable on the measuring car frame and being drivable along the track independently of the measuring car.

2. Description of the Prior Art

Such a measuring car arrangement has been disclosed in the prospectus "EM SAT Geometerwagen" of Plasser & Theurer, of Vienna, Austria. In this arrangement, a large operator's cab and a powerful drive are arranged above the plane of the machine frame. A satellite measuring bogie is connected to a laser beam emitter and is connectable to the machine frame below the frame plane for a common transit of the machine and satellite bogie between operating sites. This fully electronic recording car with a self-propelled laser satellite produces accurate track geometry corresponding to the target position of the track by measuring the actual position of the track before operation of the work machine (for reasons of greater accuracy this measurement is done using a Laser reference chord 40–300 m long); calculating the displacement value from the actual position by comparing it with the target position of the track; and supplying the work machine with this data, which also directs the machine.

U.S. Pat. No. 4,691,565, dated Sep. 8, 1987, discloses a mobile machine for measuring and recording track parameters and/or for correcting a track position, including a satellite bogie preceding the machine in an uncorrected section of the track. The self-propelled satellite bogie is equipped with a laser beam emitter and, for common transit with the machine, the satellite bogie may be driven onto the machine over a ramp pivoted to a front end of the machine frame. The machine is a track measuring car and its forward end carries a laser beam receiver and various devices for monitoring and storing track position correction values.

An article entitled "Leistungsfähige Oberbaumaschinen für moderne Gleise" (High-performance track maintenance machines for modern tracks) in "Eisenbahntechnische Rundschau" 39 (1990), No. 4, pp. 201–211, points out at 2.2 that track tamping operations must be preceded by costly measuring and processing operations monitoring the existing track position for obtaining the correction values for the desired track geometry. The article states that tests for automating such operations were undertaken with an EM-SAT measuring machine. A laser beam is used as reference chord between a satellite bogie located at a fixed track point and a measuring car continuously moving towards the satellite bogie, and the height of the arch above the reference chord is measured, the measured parameter is digitalized and the digital value is stored in a computer. Additional measurements of the lateral distances from the fixed points enable the differences between the existing and a desired track position to be monitored so that the correction values may be computed and used as input for a computer on a track lining and leveling machine for controlling the lining and/or leveling of the track. This work can be done more rapidly, more economically and protected from train traffic on a neighboring track with a track geometry car GM 80 constituted by a unit which is 17 m long and weighs 30 t, and which may be separated at an operating site into emitter and receiver parts.

SUMMARY OF THE INVENTION

It is the primary object of this invention to improve a measuring car arrangement of the first-described type by simplifying its structure and enabling it to be used most efficiently.

The above and other objects are accomplished according to the invention with a measuring car arrangement for monitoring an existing track position with respect to a desired track position, which comprises a measuring car having a frame extending longitudinally in a plane and undercarriages supporting the frame for mobility in an operating direction and having wheels which have contact points with the rail heads and the contact points defining a reference plane, the frame plane extending parallel to the reference plane, and a satellite bogie transportable on the measuring car frame and being drivable along the track independently of the measuring car. According to the present invention the measuring car and the satellite bogie have an upper periphery or outline not projecting beyond a limiting plane enclosing a dihedral angle of 5° to 10° with the reference plane, and the limiting plane and the frame plane define an intersecting line at a forward end of the measuring car in the operating direction, the intersecting line extending perpendicularly to the longitudinal extension of the frame and parallel to the reference plane.

Such a low measuring car transporting a low satellite bogie may be readily coupled to a track maintenance machine, such as a track leveling, lining and tamping machine, for transit to an operating site while the interconnected machines can be controlled from the operator's cab on the track leveling, lining and tamping machine without the view of the operator being impaired by the measuring car and satellite bogie. This combined transit of the track leveling, lining and tamping machine, the measuring car and the satellite bogie enables the measuring car to be of a very simple structure, requiring only a low-power auxiliary motor required for the operation of the measuring car at the operating site, the indicated angle of the limiting plane enabling the length of the measuring car frame to be sufficient to assure its smooth movement during transit. Furthermore, such a measuring car and satellite bogie may be coupled to existing track maintenance machines without retrofitting or other structural work. Such a common transit of the three cars enables a complete track position correction to be effected with a single closing of the track to train traffic while, at the same time, considerably reducing the logistic cost in comparison with conventional machinery.

According to a preferred embodiment, the frame of the measuring car supports a superstructure extending above the frame plane at a rear end thereof, the superstructure consisting solely of a drive motor and an upper part of an operator's cab arranged in an aperture of the frame. The satellite bogie is dimensioned for transportation on the measuring car below the frame plane and is connectable to the forward end of the measuring car ahead of a front one of the undercarriages in the operating direction. The measuring car arrangement may further comprise a device arranged at the forward end of the measuring car for lifting and releasably connecting the satellite bogie to the measuring car. This provides for an unrestricted use of the measuring car arrangement while providing a comfortable operator's cab on the measuring car.

If the forward end of the measuring car ahead of the front undercarriage has a length exceeding the length of the satellite bogie, the satellite bogie may be readily and rapidly attached to the measuring car frame below the frame plane so that the rear end of the measuring car may be coupled to the succeeding track maintenance machine.

Preferably, the measuring car arrangement further comprises a vertically adjustable measuring bogie arranged below the frame plane immediately preceding a front one of the undercarriages in the operating direction, the measuring bogie having flanged wheels and carrying a laser beam receiver including a CCD-matrix camera. In this way, the emission of a laser beam from the satellite bogie to the CCD-matrix camera establishes a laser beam reference line.

Improved measuring results are obtained and the various steps of the measuring operation may be mostly remote-controlled if drive means vertically and transversely adjust the laser beam receiver on the measuring bogie, the measuring bogie further carries an odometer comprising a sensing roller engaging one of the rail heads, the measuring bogie further carries two video cameras facing each other in a direction extending transversely to the operating direction for sensing a section of the track engaged by the flanged wheels of the measuring bogie, and the measuring bogie further carries a device for measuring the superelevation of the track.

According to one preferred feature, the measuring car arrangement further comprises a pulling hook at a rear end of the frame in the operating direction for coupling a machine to the frame, the hook being remote-controllable for releasing the coupling. In this way, the measuring car may be readily released from the machine at the operating site without requiring an operator to leave his cab and thereby possibly to endanger his safety.

Two conventionally separate operations, i.e. the measurement of the track geometry and the track geometry correction, can be effectuated very economically and efficiently in a single operating stage if a track leveling, lining and tamping machine for correcting the track position in response to the difference between the monitored existing track position with respect to the desired track position and for tamping the track in the corrected track position is coupled to the frame of the measuring car, the satellite bogie being transported thereon during transit of the tri-partite arrangement between operating sites. The low measuring car has a very simple structure, its superstructure consisting solely of a light motor sufficient for the low speeds of the measuring car during its operation and a simple cab. The logistics for an accurate timing of the various operating steps are also considerably simplified in comparison to conventional operations. In addition, conflicts of interest are avoided if the measuring and track position correction operations are carried out by one and the same company.

Such a measuring car arrangement preferably further comprises a computer on the measuring car for obtaining track position correction values derived from the difference between the monitored existing track position with respect to the desired track position and for producing output signals corresponding to the track position correction values, a control device on the track leveling, lining and tamping machine for automatically controlling the track position correction, and a wireless transmitter for transmitting the output signals of the computer to the control device. This enables the track position correction operations on the track leveling, lining and tamping machine to be exactly coordinated with the immediately preceding track position measuring operations.

The undercarriages comprise wheel axle bearings and hydraulically operable blocking devices are preferably arranged between the wheel axle bearings and the frame for holding the frame at a fixed distance from the wheel axle bearings. In this way, the measuring car frame forms a stationary unit with the axle bearings so that the resilient bearing of the frame on the undercarriages, which would falsify the measuring results, is deactivated.

The satellite bogie preferably comprises a seat for an operator, a drive for propelling the satellite bogie, a laser beam emitter and a distance measuring device for monitoring vertical and lateral deviations of the track position with respect to a fixed track point. This enables the differential between the existing and desired track positions to be monitored while the laser beam emitter is focused exactly on a fixed track point. More accurate measuring results with respect to smaller heights of an arc above the reference chord may be obtained if the laser beam emitter is mounted on a transverse adjustment device arranged to permit transverse adjustment of the laser beam emitter up to 500 mm from a center line of the track.

BRIEF DESCRIPTION OF THE DRAWING

The above and other objects, advantages and features of the present invention will become more apparent from the following detailed description of certain now preferred embodiments thereof, taken in conjunction with the accompanying somewhat schematic drawing wherein.

DETAILED DESCRIPTION OF PREFERRED EMBODIMENTS

Figure 1:
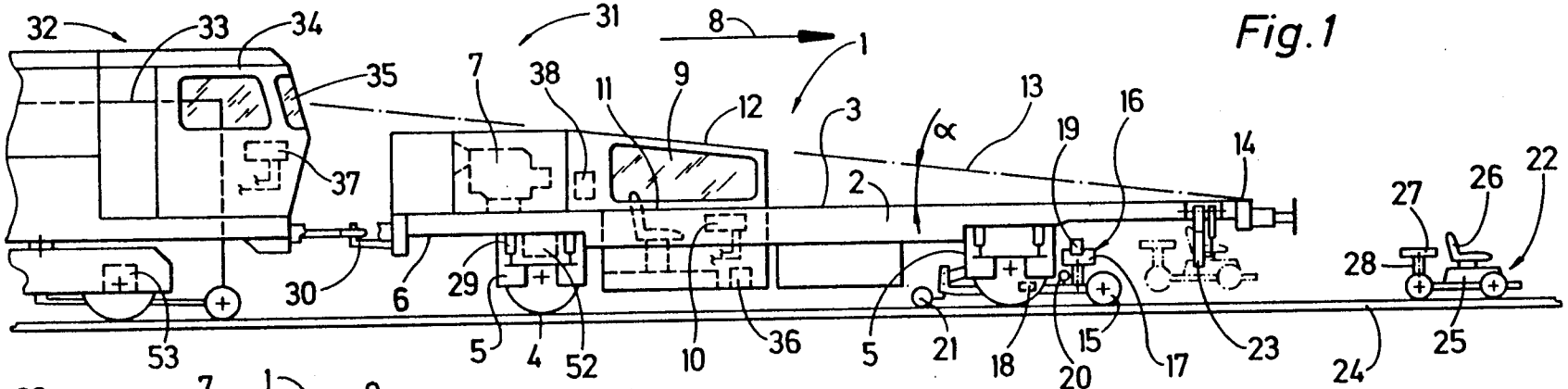
FIG. 1 is a side elevational view of a measuring car arrangement according to one embodiment of the invention, coupled to a track leveling, lining and tamping machine (which is only partially shown)
Figure 2:
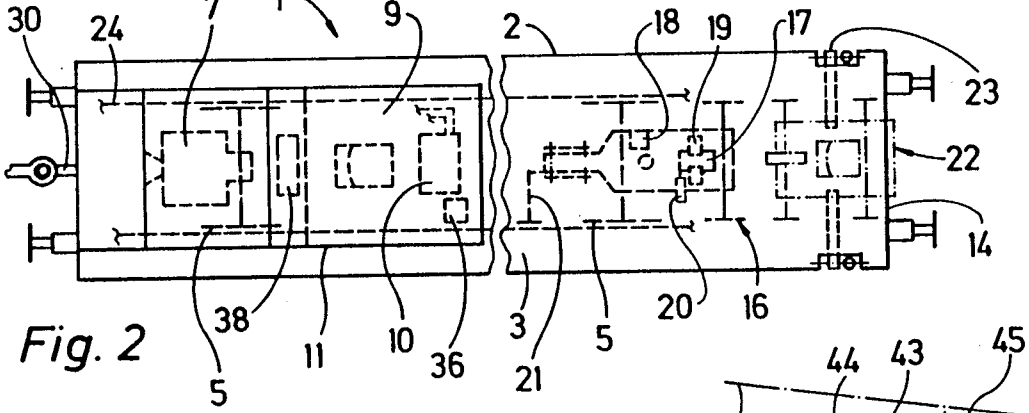
FIG. 2 is a fragmentary top view of the measuring car.

Referring now to the drawing and first to FIGS. 1 and 2, there is shown measuring car arrangement 31 for monitoring an existing track position with respect to a desired track position and for correcting the track position in response to the difference between the value of the monitored existing track position and the desired track position, and to tamp the track in the desired position. Track 24 comprises two rails having rail heads. The measuring car arrangement comprises measuring car 1 having frame 2 extending longitudinally in plane 3 and undercarriages 5 supporting frame 2 for mobility in an operating direction indicated by arrow 8. The undercarriages have wheels having contact points 4 with the rail heads and the contact points define a reference plane, frame plane 3 extending parallel to the reference plane under normal operating conditions when the resilient mountings of frame 2 on undercarriages 5 are equally loaded.

The measuring car arrangement further comprises satellite bogie 22 which is transportable on measuring car frame 2, as shown in phantom lines in FIG. 1, and is drivable along track 24 independently of measuring car 1, as shown in FIG. 1 in full lines. According to this invention, measuring, car 1 and satellite bogie 22 have an upper periphery or outline 12 not projecting beyond a limiting plane 13 enclosing a dihedral angle $\alpha$ of 5° to 10° with reference plane 3. Limiting plane 13 and frame plane 3 define intersecting line 14 at a forward end of measuring car 1 in the operating direction, which extends perpendicularly to the longitudinal extension of frame 2 and parallel to the reference plane. The rear end of limiting plane 13 is spaced from the forward end about 23 to 27 m.

Frame 2 of measuring car 1 supports a superstructure extending above frame plane 3 at rear end 6 thereof, the superstructure consisting solely of drive motor 7 and an upper part of an operator's cab 9 arranged in aperture 11 of frame 2. Drive motor 7 is a combustion engine and the measuring car can be independently propelled by drive 52.

As shown in FIG. 1, satellite bogie 22 is dimensioned for transportation on measuring car 1 below frame plane 3 and is connectable to the forward end of the measuring car ahead of a front undercarriage 5 in the operating direction. Device 23 is arranged at the forward end of measuring car 1 for releasably connecting satellite bogie 22 to the measuring car and comprises a drive lifting the satellite bogie off the track and for lowering it onto the track. The forward end of measuring car 1 ahead of front undercarriage 5 has a length exceeding the length of satellite bogie 22. As shown in phantom lines in FIG. 1, the satellite bogie is transported on the forward end of measuring car 1 during transit so that its read end may be readily coupled to a succeeding track maintenance machine.

The illustrated measuring car arrangement further comprises vertically adjustable measuring bogie 16 arranged below frame plane 3 immediately preceding front undercarriage 5 in the operating direction. The measuring bogie has flanged wheels 15 running on track 24 and carries laser beam receiver 17 including a CCD-matrix camera.

As shown, drives 20 are connected to laser beam receiver 17 for vertically and transversely adjusting the laser beam receiver on measuring bogie 16. The measuring bogie further carries odometer 21 comprising a sensing roller engaging one of the rail heads, two video cameras 19 facing each other in a direction extending transversely to the operating direction for sensing a section of the track engaged by flanged wheels 15 of measuring bogie 16, and device 18 for measuring the superelevation of the track.

Satellite bogie 22 comprises seat 26 for an operator, auxiliary drive 25 for propelling the satellite bogie, laser beam emitter 27 and a distance measuring device for monitoring vertical and lateral deviations of the track position with respect to a fixed track point. The laser beam emitter is mounted on transverse adjustment device 28 arranged to permit transverse adjustment of the laser beam emitter up to 500 mm from a center line of the track.

Undercarriages 5 comprise wheel axle bearings and hydraulically operable blocking devices 29 arranged between the wheel axle bearings and frame 2 for holding the frame at a fixed distance from the wheel axle bearings, thus eliminating the effect of the resilient frame mounting during the monitoring operation and to prevent it from being falsified by the resilient movement of the measuring car frame. The measuring car further comprises pulling hook 30 at the rear end of frame 2 in the operating direction for coupling machine 32 to the frame, the hook being remote-controllable for releasing the coupling.

In the illustrated embodiment, machine 32 is a track leveling, lining and tamping machine for correcting the track position in response to the difference between the monitored existing track position with respect to the desired track position and for tamping the track in the corrected track position, and the track leveling, lining and tamping machine is coupled to frame 2 of measuring car 1 and satellite bogie 22 is transported thereon during transit of the tri-partite arrangement between operating sites. As is well known, such machines are equipped with tamping heads, a track lifting and lining unit, track leveling and lining reference system 33, and a drive 53 for independently moving the machine along the track. Operator's cab 34 is mounted on a front end of machine 32 in the operating direction and, due to the special configuration of measuring car 1 and satellite bogie 22, an operator in cab 34 has a free field of view 35 over track 24 during transit because the upper contour of measuring car 1 does not project beyond limiting plane 13 which intersects the field of view.

Immediately before tri-partite arrangement 31 is put into operation at an operating site, hook 30 is released from machine 32 by remote control and measuring car 1 carrying satellite bogie 22 is driven on track 24 in the operating direction indicated by arrow 8 to be spaced from machine 32 by about one to two hundred meters. As soon as the track section whose position is to be monitored has been reached by measuring car 1, the measuring car is stopped, device 23 is operated to lower satellite bogie 22 onto track 24 and to release the satellite bogie from measuring car frame 2, and the satellite bogie is driven forward until it has reached the next fixed point on the track in relation to which the track position is to be measured, where the satellite bogie is positioned at a color marker on one of the track rails. The actual lateral and vertical distance of track 24 from the fixed track point is then measured, and the measured data are radioed to measuring car 1. After this measurement, satellite bogie 22 is further advanced another five to ten meters and stopped. Meanwhile, laser beam receiver 17 on measuring bogie 16 has been lowered onto track 24 and laser beam emitter 27 on satellite bogie 22 is focussed on the laser beam receiver while the satellite bogie has been clamped to one of the track rails by suitable mechanical clamping means to prevent any movement of the satellite bogie on track 24 during the measuring operation. During the entire operation, the operators on machine 32, measuring car 1 and satellite bogie 22 are in contact via radio.

After laser beam emitter 27 has been focussed on laser beam receiver 17, measuring car 1 begins monitoring the position of the track section between the measuring car and satellite bogie 22. The CCD unit of laser beam receiver 17 simultaneously measures the level and line of the track section. The track gage at the position of laser beam receiver 17, the adjustment paths and the distance covered and measured by odometer 21, and the corresponding versines of the actual track level and/or line at a preset distance are calculated from the superelevation. This computation is started only when measuring car 1 has reached the fixed track point immediately ahead of satellite bogie 22 and has been stopped at an exact point relative to the fixed track point. Only then is it possible to compute the theoretical chord under the desired heights of the arc on the basis of the chord defined by the laser beam emitted from emitter 27.

During this computation, satellite bogie 22 may be advanced to the next fixed track point by auxiliary motor 25. After the actual heights of the arc have been computed, they are compared in computer 38 on measuring car 1 with desired heights of the arc stored in the computer for obtaining track position correction values derived from the difference between the monitored existing track position with respect to the desired track position and for producing output signals corresponding to the track position correction values. Central control device 37 on track leveling, lining and tamping machine 32 automatically controls the track position correction, and wireless transmitter 36 transmits the output signals of the computer to the control device. As is well known, control device 37 controls the operation of the track lining and/or lifting tools to move the track into the desired position.

CCD-matrix cameras are commercially available devices which read the received laser beam signals in a defined area or matrix and convert them into electrical signals. The CCD (charge coupled device) unit of laser beam receiver 17 is a YZ adjustment device (transverse adjustment Y, vertical adjustment Z). Since the receiving surface of the unit is too small for receiving the entire range required, the position of the unit must be adjustable. The range of the Z-adjustment is 500 mm and that of the Y-adjustment is 1000 mm. The position of the camera relative to the adjustment device is measured by absolute encoders. The laser point is projected onto the CCD unit through a frosted glass screen and an optical lens system, and its position is computed by a suitably programmed computer whose computation is transmitted to main computer 38 on measuring car 1. Video cameras 19 on measuring bogie 16 produce a monitoring image at control console 10 in cab 9 to enable the operator to position measuring car 1 exactly in relation to the fixed track point. This is done by aligning the axle of flanged wheels 15 of measuring bogie 16 with a color marker on the rail head and web. The wheel axle serves as measuring axle and may be telescopingly structured to enable it to measure the track gage, too.

Generally speaking, this invention does not deal with the monitoring of the track position and the track position correction in response thereto, which are well known to those of ordinary skill in the art, for example from the description of the prior art hereinabove, but with the configuration and the particular disposition of the structural components of a track measuring car arrangement. The operation has been described in U.S. Pat. No. 4,691,565.

After the operation has been completed, tri-partite measuring car arrangement 31 is unitized by hooking measuring car 1 to machine 32 by hook 30 and attaching satellite bogie 22 to device 23 on measuring car frame 2 and lifting the attached satellite bogie off the track. The operator in cab 34 now has track 24 in full view and is able to drive the measuring car arrangement to another operating site in the direction of arrow 8.

Figure 3:
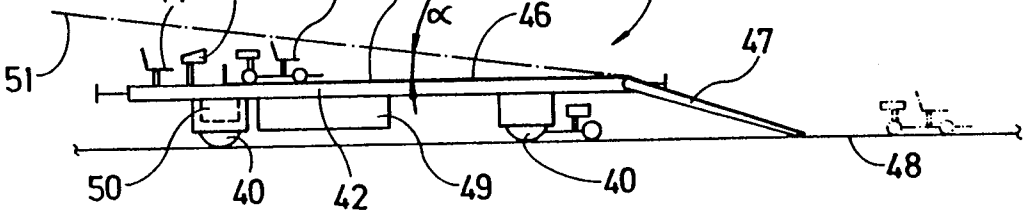
FIG. 3 is a diagrammatic side elevational view of another embodiment of the measuring car.

FIG. 3 illustrates another embodiment of the track measuring car arrangement. In this embodiment, measuring car 39 has frame 42 supported by undercarriages 40, 40 on track 48 and defining frame plane 41 extending parallel to the plane of the track. The measuring car has a superstructure consisting of operator's seat 44 mounted at a rear end of the car frame in the operating direction and central control panel 43 facing the operator's seat. Forwardly of the control panel and immediately adjacent thereto, car frame 42 provides room for independently movable satellite bogie 45. As shown, ramp 47 is pivoted to a forward end of the measuring car frame in the operating direction and is pivotal into an inclined operating position for transferring satellite bogie 45 from a transport position on the frame (shown in full lines) to track 48 (as shown in phantom lines). For this purpose, rails 46 are affixed to frame 42 and ramp 47 to enable the satellite bogie to be driven off the car frame onto the track. During transit, ramp 47 may be pivoted upwardly into a rest position, for which purpose pivoting drives (not shown) connect the ramp to the frame. Measuring car 39 has a drive motor 49 mounted on frame 42 underneath the frame plane and a drive 50 for propelling the car along track 48. Limiting plane 51 encloses an angle $\alpha$ of 8° with frame plane 46 and the upper contours of the measuring car superstructure and of the satellite bogie are dimensioned not to project beyond the limiting plane.

What is claimed is:

1. A measuring car arrangement for monitoring an existing track position with respect to a desired track position, the track comprising two rails having rail heads, which comprises (1) a measuring car having (1) a frame extending longitudinally in a plane and (2) undercarriages supporting the frame for mobility in an operating direction and having wheels, the wheels having contact points with the rail heads and the contact points defining a reference plane, the frame plane extending parallel to the reference plane, (2) a satellite bogie transportable on the measuring car frame and being drivable along the track independently of the measuring car, (3) the measuring car and the satellite bogie having an upper periphery not projecting beyond a limiting plane enclosing a dihedral angle of 5° to 10° with the reference plane, and (4) the limiting plane and the frame plane defining an intersecting line at a forward end of the measuring car in the operating direction, the intersecting line extending perpendicularly to the longitudinal extension of the frame and parallel to the reference plane.

2. The measuring car arrangement of claim 1, wherein the frame of the measuring car supports a superstructure extending above the frame plane at a rear end thereof, the superstructure consisting solely of a drive motor and an upper part of an operator's cab arranged in an aperture of the frame.

3. The measuring car arrangement of claim 1, wherein the satellite bogie is dimensioned for transportation on the measuring car below the frame plane and is connectable to the forward end of the measuring car ahead of a front one of the undercarriages in the operating direction.

4. The measuring car arrangement of claim 3, further comprising a device arranged at the forward end of the measuring car for lifting and releasably connecting the satellite bogie to the measuring car.

5. The measuring car arrangement of claim 3, wherein the forward end of the measuring car ahead of the front undercarriage has a length exceeding the length of the satellite bogie.

6. The measuring car arrangement of claim 1, further comprising a vertically adjustable measuring bogie arranged below the frame plane immediately preceding a front one of the undercarriages in the operating direction, the measuring bogie having flanged wheels and carrying a laser beam receiver including a CCD-matrix camera.

7. The measuring car arrangement of claim 6, further comprising drive means for vertically and transversely adjusting the laser beam receiver on the measuring bogie.

8. The measuring car arrangement of claim 6, wherein the measuring bogie further carries an odometer comprising a sensing roller engaging one of the rail heads.

9. The measuring car arrangement of claim 6, wherein the measuring bogie further carries two video cameras facing each other in a direction extending transversely to the operating direction for sensing a section of the track engaged by the flanged wheels of the measuring bogie.

10. The measuring car arrangement of claim 6, wherein the measuring bogie further carries a device for measuring the superelevation of the track.

11. The measuring car arrangement of claim 1, further comprising a pulling hook at a rear end of the frame in the operating direction for coupling a machine to the frame, the hook being remote-controllable for releasing the coupling.

12. The measuring car arrangement of claim 11, wherein the machine is a track leveling, lining and tamping machine for correcting the track position in response to the difference between the monitored existing track position with respect to the desired track position and for tamping the track in the corrected track position, the track leveling, lining and tamping machine being coupled to the frame of the measuring car and the satellite bogie being transported thereon during transit of the tri-partite arrangement between operating sites.

13. The measuring car arrangement of claim 12, further comprising a computer on the measuring car for obtaining track position correction values derived from the difference between the monitored existing track position with respect to the desired track position and for producing output signals corresponding to the track position correction values, a control device on the track leveling, lining and tamping machine for automatically controlling the track position correction, and a wireless transmitter for transmitting the output signals of the computer to the control device.

14. The measuring car arrangement of claim 1, wherein the undercarriages comprise wheel axle bearings and hydraulically operable blocking devices arranged between the wheel axle bearings and the frame for holding the frame at a fixed distance from the wheel axle bearings.

15. The measuring car arrangement of claim 1, wherein the satellite bogie comprises a seat for an operator, a drive for propelling the satellite bogie, a laser beam emitter and a distance measuring device for monitoring vertical and lateral deviations of the track position with respect to a fixed track point.

16. The measuring car arrangement of claim 15, wherein the laser beam emitter is mounted on a transverse adjustment device arranged to permit transverse adjustment of the laser beam emitter up to 500 mm from a center line of the track.

17. The measuring car arrangement of claim 1, further comprising a ramp pivoted on a forward end of the measuring car frame in the operating direction and pivotal into an inclined operating position for transferring the satellite bogie from a transport position on the frame to the track.

* * * * *